US006892860B2

(12) United States Patent
Gibson et al.

(10) Patent No.: US 6,892,860 B2
(45) Date of Patent: May 17, 2005

(54) SCAFFOLD WITH LEG LOCK

(75) Inventors: William R. Gibson, Kent, OH (US); Paul K. Meeker, Hiram, OH (US); Luke Hillebrecht, Kent, OH (US)

(73) Assignee: Cosco Management, Inc., Wilmington, DE (US)

( * ) Notice: Subject to any disclaimer, the term of this patent is extended or adjusted under 35 U.S.C. 154(b) by 0 days.

(21) Appl. No.: 10/636,393

(22) Filed: Aug. 7, 2003

(65) Prior Publication Data

US 2004/0238280 A1 Dec. 2, 2004

Related U.S. Application Data

(60) Provisional application No. 60/473,840, filed on May 28, 2003.

(51) Int. Cl.[7] ..... E04G 1/16; A47B 3/02

(52) U.S. Cl. ..... 182/222; 108/119; 108/131

(58) Field of Search ..... 182/222, 223, 182/33, 115–119; 297/423.41; 403/321, 325, 322.1, 322.3, 322.4; 108/119, 118, 115, 131, 26, 25, 154, 126, 125, 130, 133, 129

(56) References Cited

U.S. PATENT DOCUMENTS

| | | | | | |
|---|---|---|---|---|---|
| 391,182 | A | * | 10/1888 | Nosker | 182/223 |
| 1,627,454 | A | * | 5/1927 | Phalon | 108/129 |
| 3,700,072 | A | | 10/1972 | Lovett | |
| 3,845,728 | A | * | 11/1974 | Piretti | 108/131 |
| 3,857,343 | A | * | 12/1974 | Greenberg | 108/133 |
| 4,047,594 | A | | 9/1977 | Eisenberg | |
| 4,241,808 | A | | 12/1980 | Middleton et al. | |
| 4,298,096 | A | | 11/1981 | Prior | |
| 4,462,636 | A | * | 7/1984 | Markson | 297/423.41 |
| 4,570,752 | A | | 2/1986 | Chapman et al. | |
| 4,576,251 | A | * | 3/1986 | Matsuura et al. | 182/118 |
| 4,640,385 | A | | 2/1987 | Underhill | |
| 4,645,162 | A | | 2/1987 | Roy et al. | |
| 4,690,248 | A | | 9/1987 | Killeen | |
| 4,823,913 | A | | 4/1989 | Riegel, Jr. | |
| 4,880,080 | A | | 11/1989 | Brockman | |
| 4,951,780 | A | * | 8/1990 | Kim | 182/119 |
| 5,031,723 | A | | 7/1991 | Hooten | |
| 5,082,249 | A | | 1/1992 | Havlovitz | |
| 5,096,019 | A | | 3/1992 | Kelsay | |
| 5,191,954 | A | | 3/1993 | Ledford | |
| 5,275,256 | A | | 1/1994 | Ellzey | |
| 5,342,008 | A | | 8/1994 | Kay | |
| 5,358,070 | A | | 10/1994 | Bartnicki et al. | |
| 5,368,126 | A | * | 11/1994 | Woodward et al. | 182/118 |
| 5,419,409 | A | | 5/1995 | Corulla | |
| 5,431,249 | A | | 7/1995 | Tredup | |
| 5,544,718 | A | | 8/1996 | Schumacher | |
| 5,622,463 | A | | 4/1997 | Testa | |
| 5,673,885 | A | | 10/1997 | Pham | |
| 5,722,507 | A | | 3/1998 | Kain | |
| 5,740,883 | A | | 4/1998 | Trank | |
| 5,758,744 | A | | 6/1998 | Forino | |
| 5,865,269 | A | | 2/1999 | Eskesen | |
| 5,913,380 | A | | 6/1999 | Gugel et al. | |
| 5,937,968 | A | | 8/1999 | Gibson et al. | |
| 5,954,156 | A | | 9/1999 | Cooke | |
| 5,967,259 | A | | 10/1999 | Williams | |
| 6,000,497 | A | | 12/1999 | Kain et al. | |
| 6,131,699 | A | | 10/2000 | Leak, Jr. | |
| 6,209,683 | B1 | | 4/2001 | Holtz | |

(Continued)

OTHER PUBLICATIONS

Images of product from Tricam Industries (6 pages) (before May 28, 2003).

*Primary Examiner*—Hugh B. Thompson, II
(74) *Attorney, Agent, or Firm*—Barnes & Thornburg LLP

(57) ABSTRACT

A scaffold includes a platform, a pivotable leg unit, and a leg lock. The leg lock is used to lock the leg unit in an extended position for use of the scaffold.

27 Claims, 7 Drawing Sheets

U.S. PATENT DOCUMENTS

| | | | |
|---|---|---|---|
| 6,341,666 | B1 | 1/2002 | Allen |
| 6,390,238 | B1 | 5/2002 | Gibson et al. |
| 6,427,804 | B1 | 8/2002 | Lazarus |
| 6,427,805 | B1 | 8/2002 | Gibson et al. |
| 6,443,260 | B1 | 9/2002 | Katz et al. |
| 6,454,050 | B2 | 9/2002 | Gibson et al. |
| 6,536,557 | B2 | 3/2003 | Gibson et al. |
| 6,550,579 | B2 | 4/2003 | Gibson et al. |
| 2002/0017430 | A1 | 2/2002 | Rosko |
| 2002/0166725 | A1 | 11/2002 | Gulledge |
| 2003/0029676 | A1 | 2/2003 | Gibson et al. |

* cited by examiner

SCAFFOLD WITH LEG LOCK

This application claims priority under 35 U.S.C. §119(e) to U.S. Provisional Application No. 60/473,840, filed May 28, 2003, which is hereby incorporated by reference herein.

BACKGROUND

The present disclosure relates to scaffolds.

Scaffolds are used by individuals for elevation. Elevation may be helpful when working in hard-to-reach areas.

SUMMARY

According to the present disclosure, a scaffold includes a platform to support a person thereon, a leg unit, and a leg lock. The leg unit is coupled to the platform for pivotable movement between an extended position for use of the scaffold and a collapsed position for transport and storage of the scaffold. A leg lock is used to lock the leg unit in the extended position.

The platform includes a plank and a plank end cap. The plank is elongated so as to include opposite plank end portions. The plank end cap is coupled to one of the plank end portions.

In one embodiment, a latch of the leg lock is coupled to the leg unit for pivotable movement between a latch position and a release position. In the latch position, the latch is arranged to latch to the plank end cap to lock the leg unit in the extended position. In the release position, the latch is arranged to release the plank end cap to allow pivotable movement of the leg unit from the extended position to the collapsed position.

In another embodiment, the latch is coupled to the plank end cap for pivotable movement between latch and release positions. In the latch position, the latch is arranged to latch to the leg unit to lock the leg unit in the extended position. In the release position, the latch is arranged to release the leg unit to allow pivotable movement of the leg unit from the extended position to the collapsed position.

In both embodiments, the leg lock includes a latch pivoter. The latch pivoter is used to pivot the latch to its latch position after, for example, release of the leg unit.

Additional features of the apparatus will become apparent to those skilled in the art upon consideration of the following detailed description exemplifying the best mode of the disclosure as presently perceived.

BRIEF DESCRIPTION OF THE DRAWINGS

The detailed description particularly refers to the accompanying figures in which.

DETAILED DESCRIPTION

Figure 1:
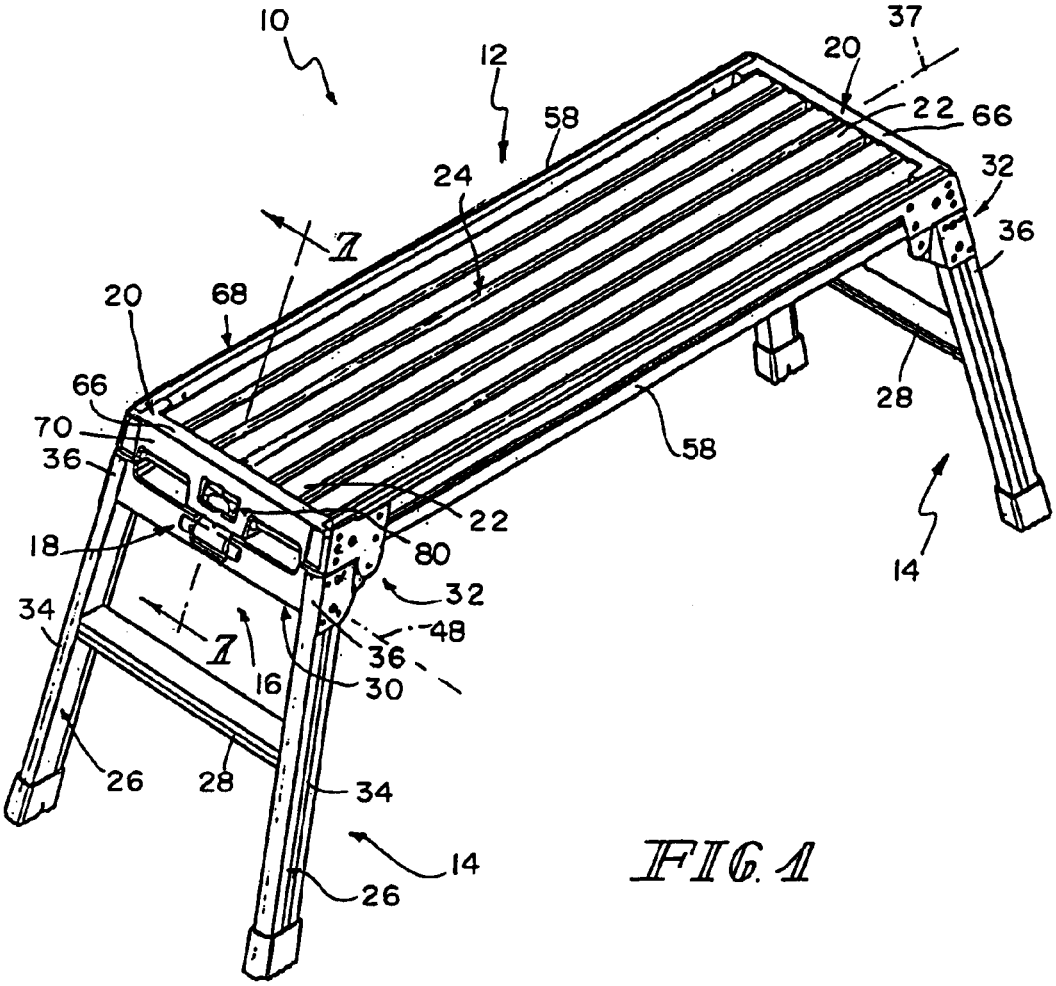
FIG. 1 is a perspective view of a first scaffold showing the scaffold including a platform, a pair of leg units coupled to the platform for pivotable movement and positioned in an extended position, and a push-to-release latch coupled to one of the leg units and positioned in a latch position to latch to a plank end cap coupled to an end portion of a plank of the platform to lock the leg unit in the extended position.
Figure 2:
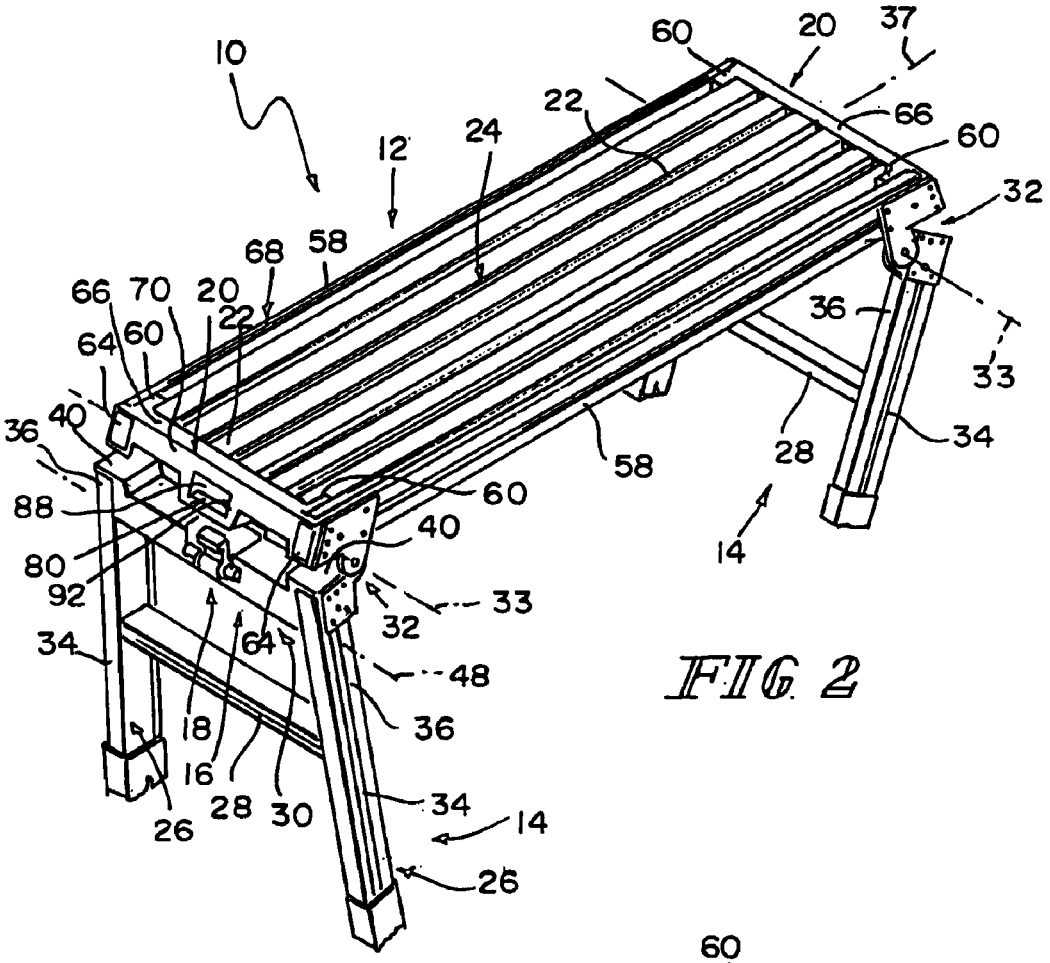
FIG. 2 is a perspective view of the first scaffold showing partial collapse of a leg unit associated with each end portion of the plank.
Figure 3:
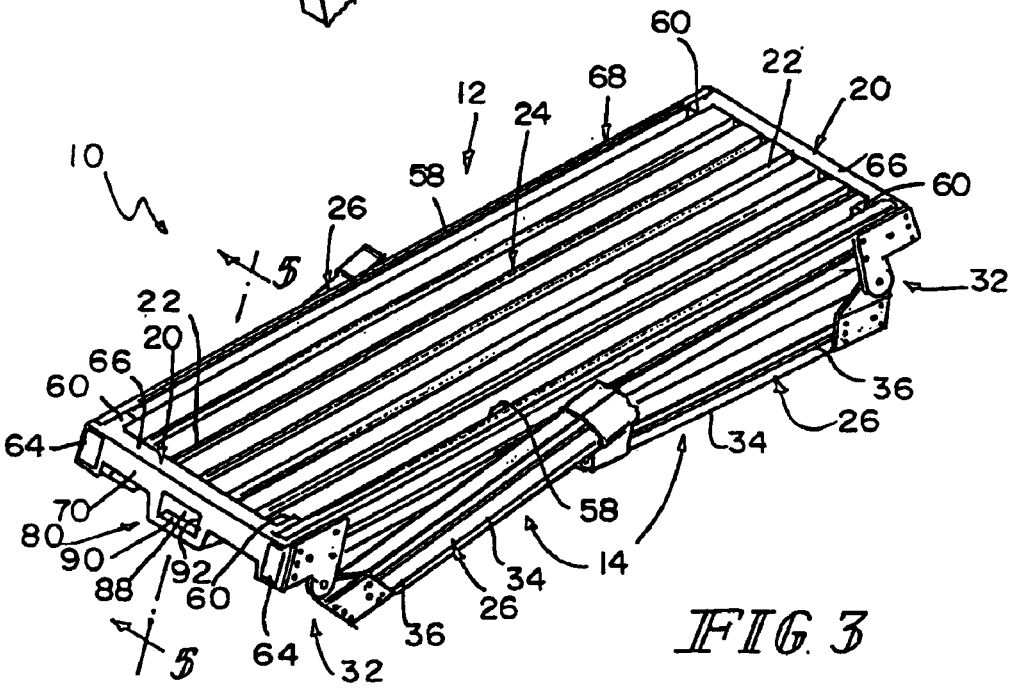
FIG. 3 is a perspective view of the first scaffold showing the leg units in collapsed positions.

A scaffold 10 shown in FIGS. 1–3 is configured to be used for elevation of an individual. Scaffold 10 includes an elongated platform 12 and a pair of leg units 14 coupled to platform 12 for pivotable movement relative thereto between an extended position shown in FIGS. 1 and 7 for use of scaffold 10 and a collapsed position shown in FIGS. 3 and 5 for transport and storage of scaffold 10. A scaffold 110 in accordance with another embodiment of the disclosure is shown, for example, in FIGS. 8–11.

A leg lock 16 shown in FIGS. 1–7 is associated with each leg unit 14 to lock leg unit 14 in the extended position and to allow pivotable movement of leg unit 14 between the extended and collapsed positions. Leg lock 16 thus provides leg lock means for locking leg unit 14 in the extended position and for allowing pivotable movement of leg unit 14 between the extended position and the collapsed position.

Leg lock 16 includes a push-to-release latch 18 and a latch pivoter 19. Latch 18 is coupled to leg unit 14 for pivotable movement relative thereto about a latch pivot axis 48 between a latch position shown in FIGS. 1, 5, and 7 and a release position suggested in FIG. 7. In the latch position, latch 18 is arranged to latch to a plank end cap 20 coupled to an end portion 22 of a plank 24 included in platform 12 to lock leg unit 14 in the extended position when leg unit 14 assumes the extended position. In the release position, latch 18 is arranged to release plank end cap 20 to allow pivotable movement of leg unit 14 from the extended position to the collapsed position. Latch pivot axis 48 is perpendicular to a longitudinal axis 37 of plank 24.

Figure 5:
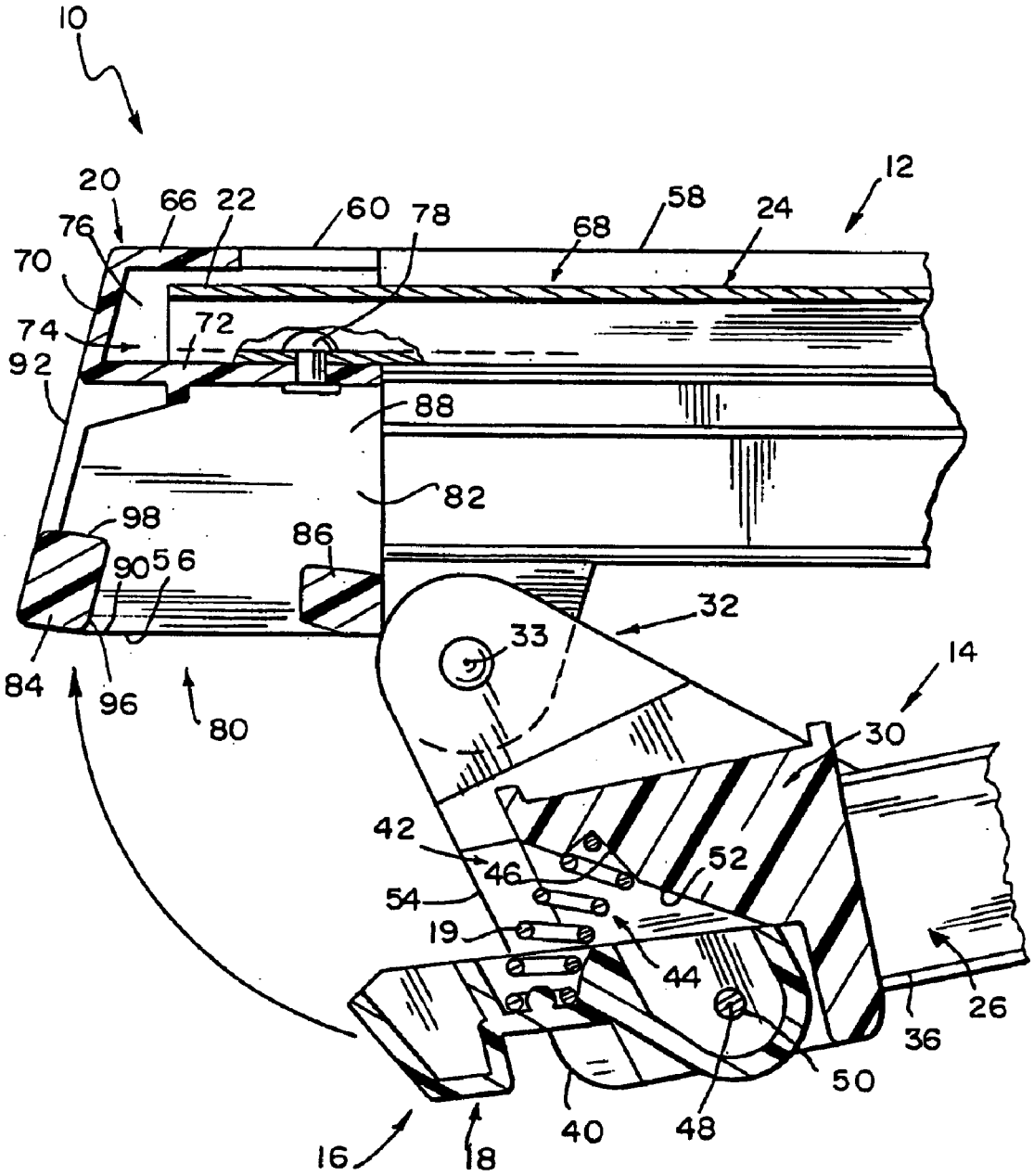
FIG. 5 is a sectional view taken along lines 5—5 of FIG. 3 showing the leg unit in its collapsed position and the latch in its latch position.
Figure 6:
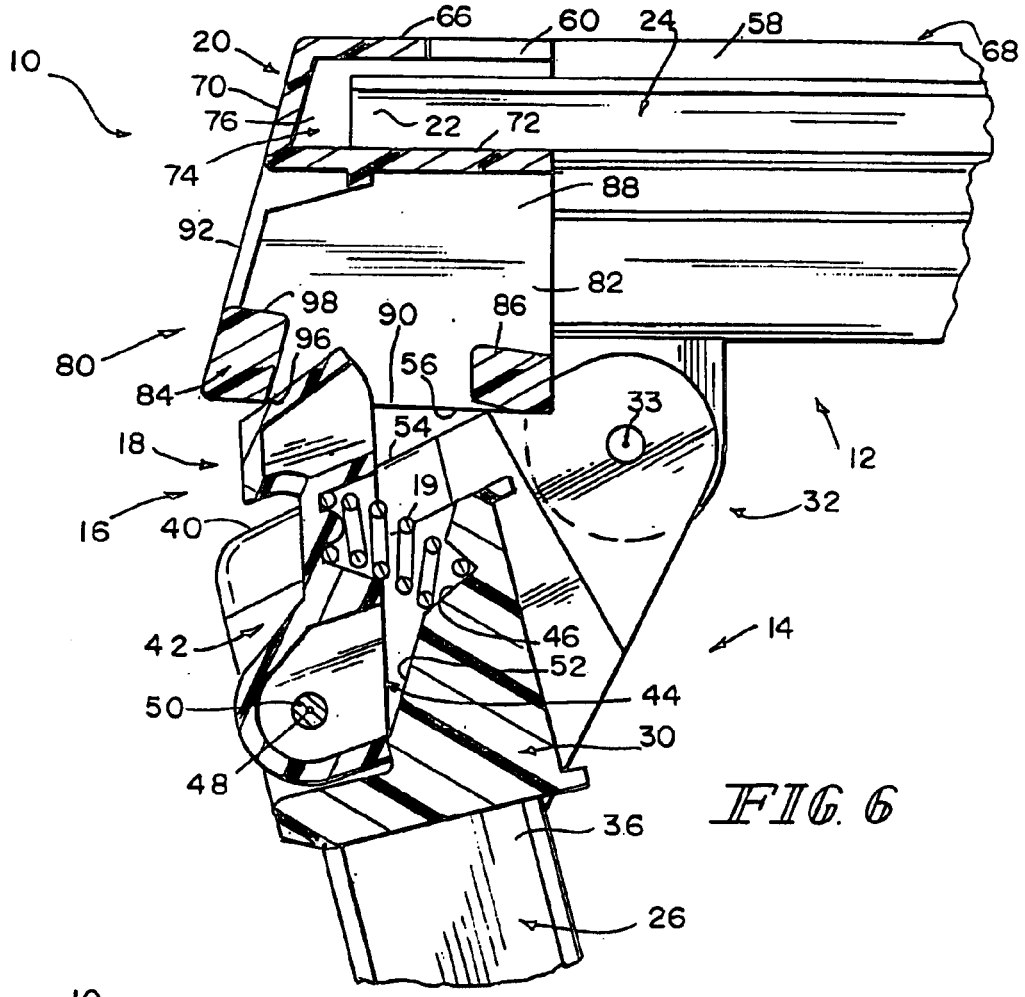
FIG. 6 is a sectional view taken along lines 6—6 of FIG. 2 showing engagement between the latch and the plank end cap to pivot the latch away from the latch position for reception through a latch-receiving aperture into a latch-receiving cavity formed in the plank end cap upon pivotable movement of the leg unit in a clockwise direction toward the extended position.
Figure 7:
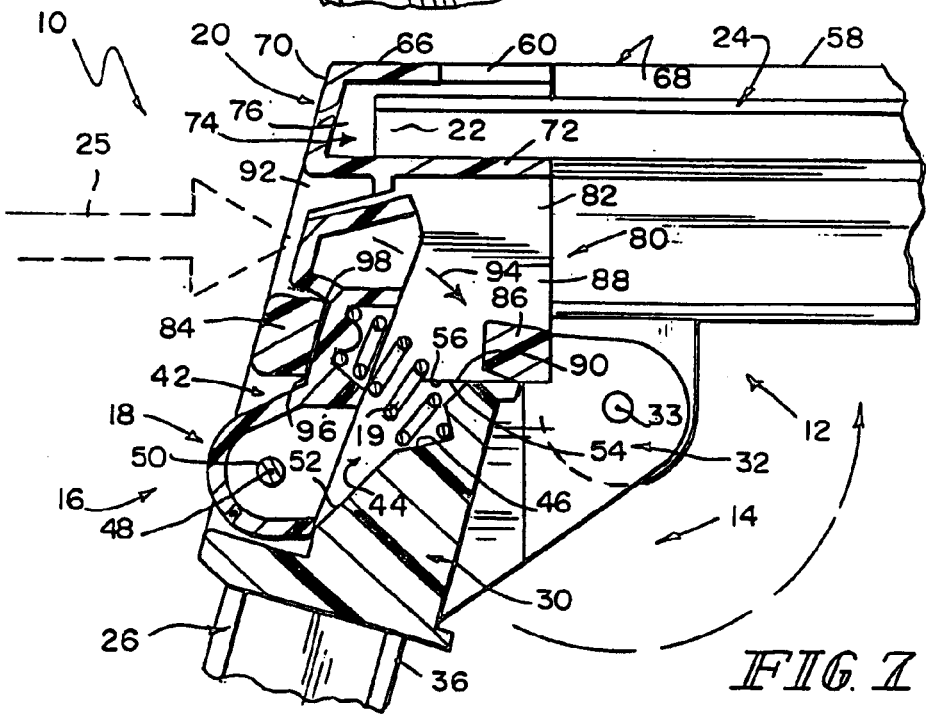
FIG. 7 is a sectional view taken along lines 7—7 of FIG. 1 showing reception of the latch in the cavity formed in the plank end cap to latch to the plank end cap to lock the leg unit in the extended position and showing that the latch can be pivoted inwardly by a release force through a latch access opening formed in the plank end cap to release the leg unit for pivotable movement in a counterclockwise direction back to the collapsed position.

Latch pivoter 19 shown in FIGS. 4–7 is used to pivot latch 18 from the release position to the latch position upon removal of a release force 25, shown in FIG. 7, from latch 18. In the illustrated embodiment, latch pivoter 19 is a coil spring.

Leg unit 14 includes a pair of legs 26, a step 28, and a leg connector 30, as shown in FIGS. 1 and 2. Each leg 26 is coupled to platform 12 by a leg pivot mount 32 for pivotable movement about a leg pivot axis 33 that is perpendicular to longitudinal plank axis 37 and parallel to latch pivot axis 48. Step 28 extends between legs 26 and is coupled to middle portions 34 thereof. Leg connector 30 extends between legs 26 and includes a leg attachment 35 coupled to a top portion 36 of each leg 26 using fasteners 38. A leg cover 40 extends laterally from each leg attachment 35 to cover the top portion 36 to which the leg attachment 35 is coupled.

Figure 4:
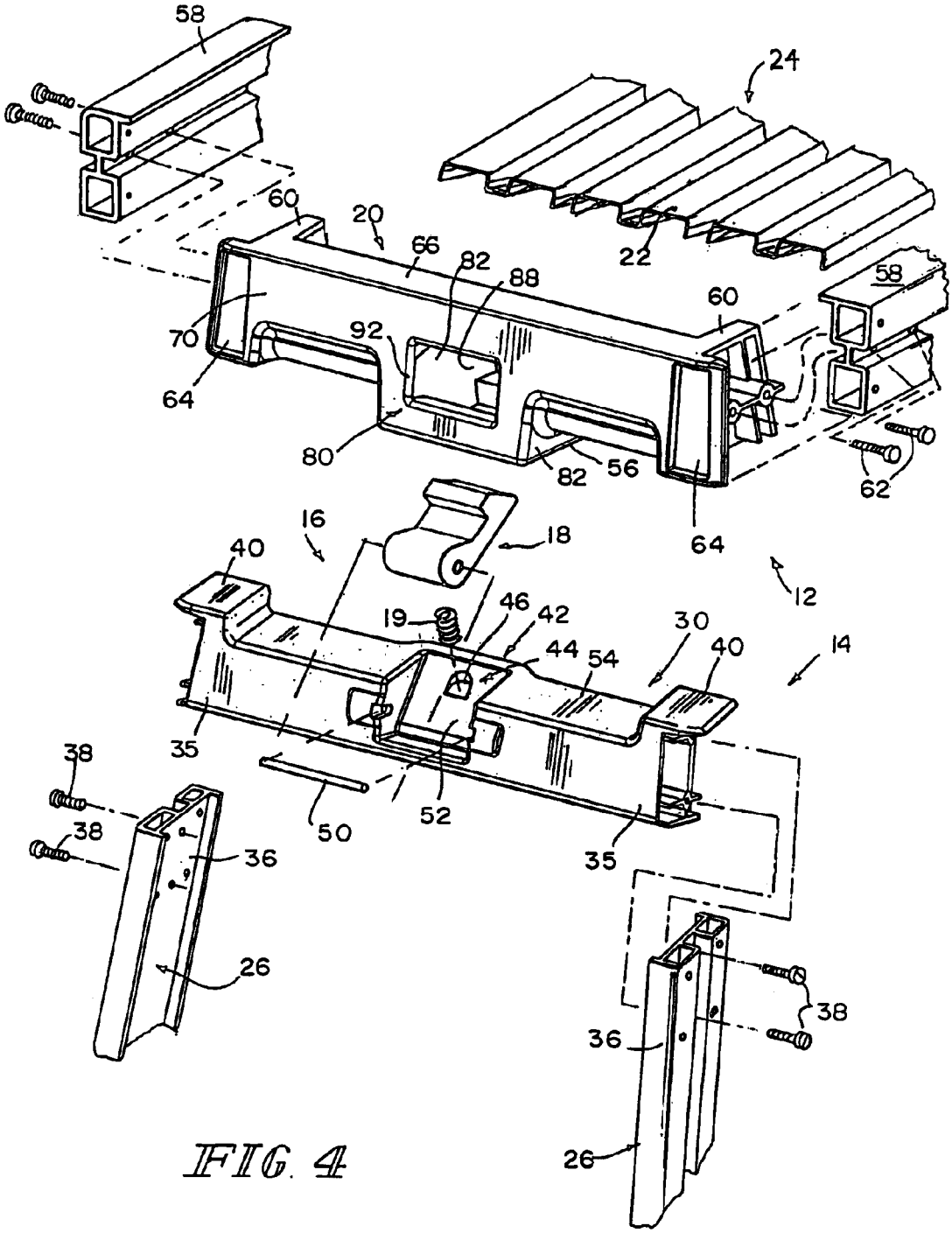
FIG. 4 is an exploded perspective view, with portions broken away, of components included in one of the leg units and a companion push-to-release latch showing that the plank end cap is configured to be coupled to an end portion of the plank and a pair of side rails and showing that the latch is configured to be coupled to a leg connector between a pair of legs of the leg unit and that a latch pivoter in the form of, for example, a coil spring is arranged to be captured between the latch and the latch connector.

Leg lock 16 is coupled to a leg lock mount 42 shown in FIG. 4 and formed in a middle portion of leg connector 30. Leg lock mount 42 includes a larger recessed portion 44 and a smaller recessed portion 46. Latch 18 is positioned within larger recessed portion 44 for pivotable movement about latch pivot axis 48 established by a latch pivot axle 50 extending through latch 18 and coupled to larger recessed portion 44. Smaller recessed portion 46 is recessed from an inclined wall 52 included in larger recessed portion 44. Leg connector 30 includes an upper wall 54 that mates with a lower wall 56 included in plank end cap 20 when leg unit 14 assumes the extended position, as shown in FIG. 7.

Plank end cap 20 is arranged to extend laterally along plank end portion 22 between side rails 58 that are included in platform 12 and extend longitudinally along sides of plank 24, as shown in FIGS. 1–3. Plank end cap 20 includes a side rail attachment 60 shown in FIG. 4 and coupled to each side rail 58 by fasteners 62. A side rail cover 64 extends laterally from each side rail attachment 60 to cover an end of one of side rails 58. A top wall 66 of each plank end cap 20 cooperates with side rails 58 to provide a rim 68 around plank 24.

Top wall 66, an outer wall 70, and an intermediate wall 72 cooperate to provide a plank receiver 74 included in plank end cap 20, as shown in FIGS. 5–7. End portion 22 extends into an end-receiving space 76 provided between top and intermediate walls 66, 72. Intermediate wall 72 and plank end portion 22 are coupled to one another by a fastener 78.

Plank end cap 20 includes a latch receiver 80 in a middle portion thereof between side rail attachments 60 and below plank receiver 74, as shown best in FIGS. 4–7. Latch receiver 80 is arranged to receive latch 18 therein upon pivotable movement of leg unit 14 from the collapsed position to the extended position. Outer wall 70, intermediate wall 72, lower wall 56, side walls 82, outer support 84, and inner support 86 cooperate to provide latch receiver 80.

Latch receiver 80 is formed to include a latch-receiving cavity 88, a latch-receiving opening 90, and a latch access opening 92, as shown in FIGS. 5–7. Lower wall 56 is formed to include latch-receiving opening 90. Outer wall 70 is formed to include latch access opening 92. Latch 18 is arranged to extend through latch-receiving opening 90 into cavity 88 when leg unit 14 assumes the extended position. Latch 18 enters and exits cavity 88 through latch-receiving opening 90 as leg unit 14 pivots between the extended and collapsed positions. Latch access opening 92 provides access to latch 18 for application of an inwardly directed release force 25 thereto to pivot latch in a release direction 94 shown in FIG. 7 to the release position to allow pivotable movement of leg unit 14 to the collapsed position.

An edge between lower wall 56 and outer support 84 provides a latch pivoter 96, as shown best in FIG. 6. Latch pivoter 96 is arranged for engagement with latch 18 to pivot latch 18 inwardly away from the latch position for reception of latch 18 in latch receiver 80 upon pivotable movement of leg unit to the extended position. Latch pivoter 96 defines an outer portion of latch-receiving opening 90.

A pivot blocker 98 shown best in FIG. 7 is arranged to engage latch 18 to block pivotable movement of leg unit 14 from the extended position to the collapsed position when leg unit 14 is in the extended position. Pivot blocker 98 is included in outer support 84.

A scaffold 110 shown in FIGS. 8–11 is configured to be used for elevation of an individual. Scaffold 110 includes an elongated platform 112 and a pair of leg units 114 coupled to platform 112 for pivotable movement relative thereto between a collapsed position shown in FIG. 9 for transport and storage of scaffold 110 and an extended position shown in FIG. 11 for use of scaffold 110. A plank end cap 120 is coupled to each longitudinal end 122 of a plank 124 of platform 112.

A leg lock 116 is associated with each leg unit 114 to lock leg unit 114 in the extended position and to allow pivotable movement of leg unit 114 between the extended and collapsed positions. Leg lock 116 thus provides leg lock means for locking leg unit 114 in the extended position and for allowing pivotable movement of leg unit 114 between the extended position and the collapsed position.

Leg lock 116 includes a pull-to-release latch 118 and a latch pivoter 119. Latch 118 is coupled to plank end cap 120 for pivotable movement relative thereto about a latch pivot axis 148 between a latch position shown in FIGS. 8, 9, and 11 and a release position suggested in FIG. 10. In the latch position, latch 118 is arranged to latch to leg unit 114 to lock leg unit 114 in the extended position when leg unit 114 assumes the extended position. In the release position, latch 118 is arranged to release leg unit 114 to allow pivotable movement of leg unit 114 from the extended position to the collapsed position. Latch pivot axis 148 is established by a latch pivot axle 150 and is perpendicular to a longitudinal axis 137 of plank 124.

Figure 9:
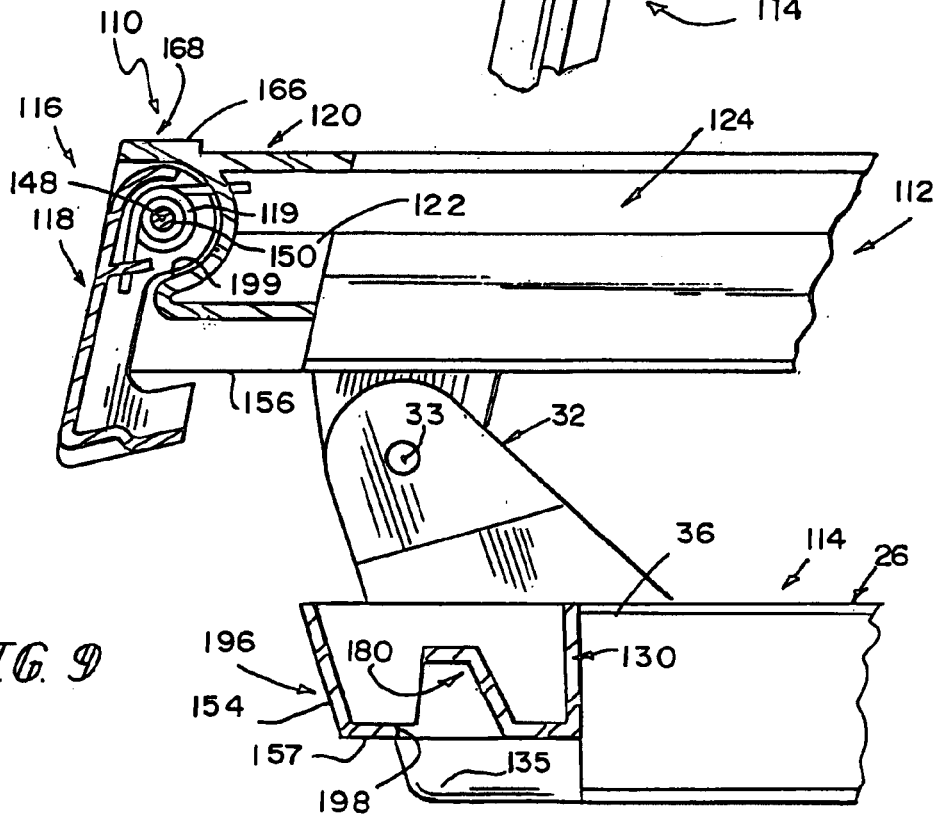
FIG. 9 is a sectional view of the second scaffold, with portions broken away, showing the leg unit in a collapsed position and the latch coupled to the plank end cap in a latch position.
Figure 10:
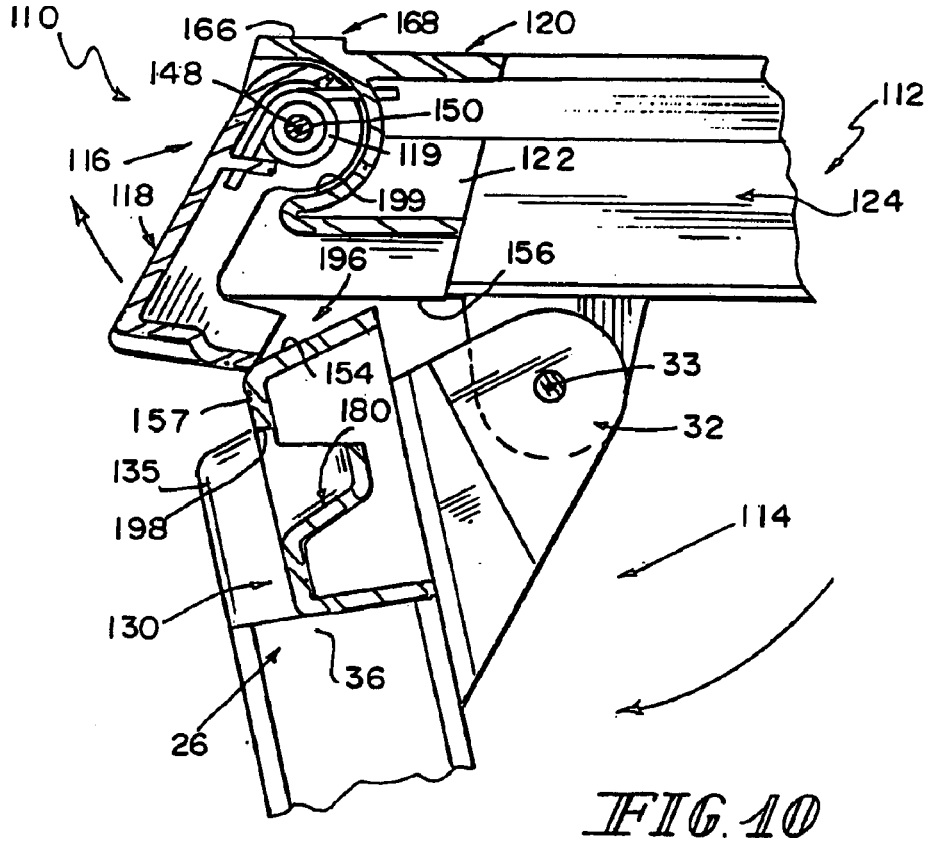
FIG. 10 is a sectional view of the second scaffold, with portions broken away, showing engagement between the latch and the leg unit to pivot the latch away from the latch position for reception in a recessed portion formed in the leg unit upon pivotable movement of the leg unit toward the extended position.
Figure 11:
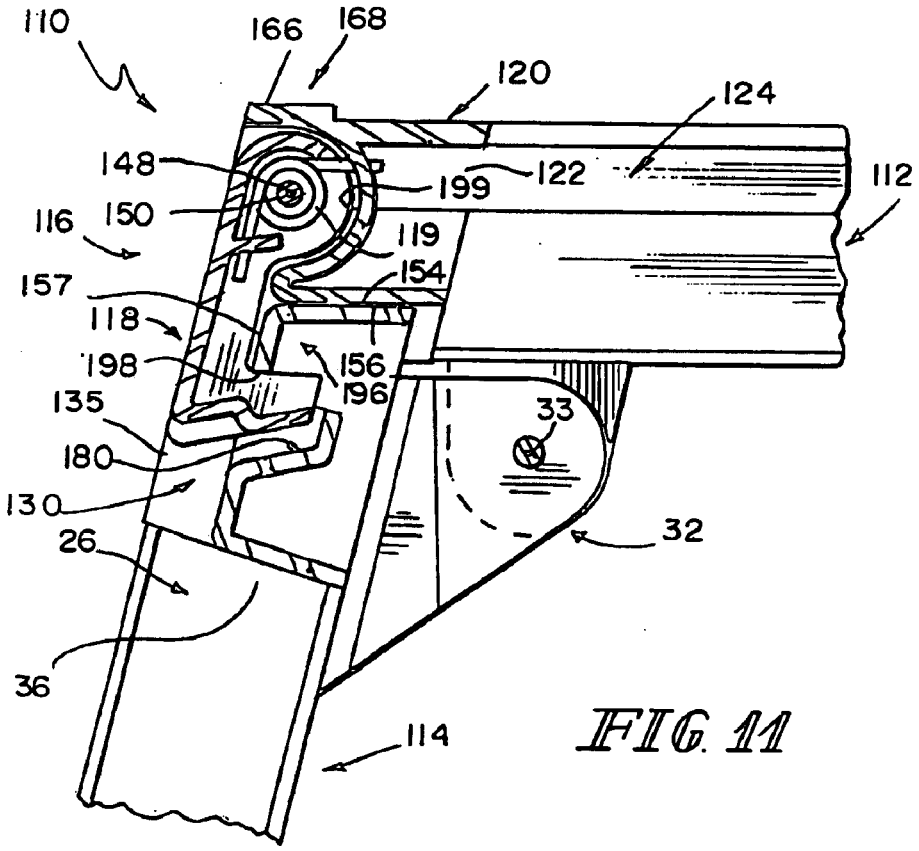
FIG. 11 is a sectional view taken along lines 11—11, with portions broken away, showing reception of the latch in the recessed portion formed in the leg unit to latch to the leg unit to lock the leg unit in the extended position.

Latch pivoter 119 shown in FIGS. 9–11 is used to pivot latch 118 inwardly from the release position to the latch position upon removal of an outward release force on latch 118. In the illustrated embodiment, latch pivoter 119 is a torsion spring.

Leg unit 114 is similar to leg unit 14 so that like reference numbers refer to like components. Leg unit 114 is coupled to plank 124 by a leg pivot mount 32 for pivotable movement about a leg pivot axis 33 which is perpendicular to plank longitudinal axis 137 and parallel to latch pivot axis 148. A leg connector 130 extends between legs 26 and includes a leg attachment 135 coupled to a top portion 36 of each leg 26.

Leg connector 130 includes a latch receiver 180 shown in FIGS. 9–11 and arranged to receive latch 118 upon pivotable movement of leg unit 114 to the extended position. In the illustrated embodiment, latch receiver 180 is a recessed portion formed in a middle portion of leg connector 130.

Leg connector 130 includes a latch pivoter 196 shown in FIGS. 9–11. Latch pivoter 196 is arranged to engage latch 118 to pivot latch 118 outwardly away from the latch position upon pivotable movement of latch 118 from the collapsed position to the extended position, as suggested in FIG. 10. In the illustrated embodiment, an upper wall 154 and an outer wall 157 of leg connector 130 cooperate to provide latch pivoter 196. Upper wall 154 is arranged to mate with a lower wall 156 of plank end cap 120 when leg unit 114 assumes the extended position.

An edge of outer wall 157 is arranged to provide a pivot blocker 198, as shown best in FIG. 11. Pivot blocker 198 is arranged to engage latch 118 to block pivotable movement of leg unit 114 from the extended position to the collapsed position when the leg unit 114 is in the extended position.

Figure 8:
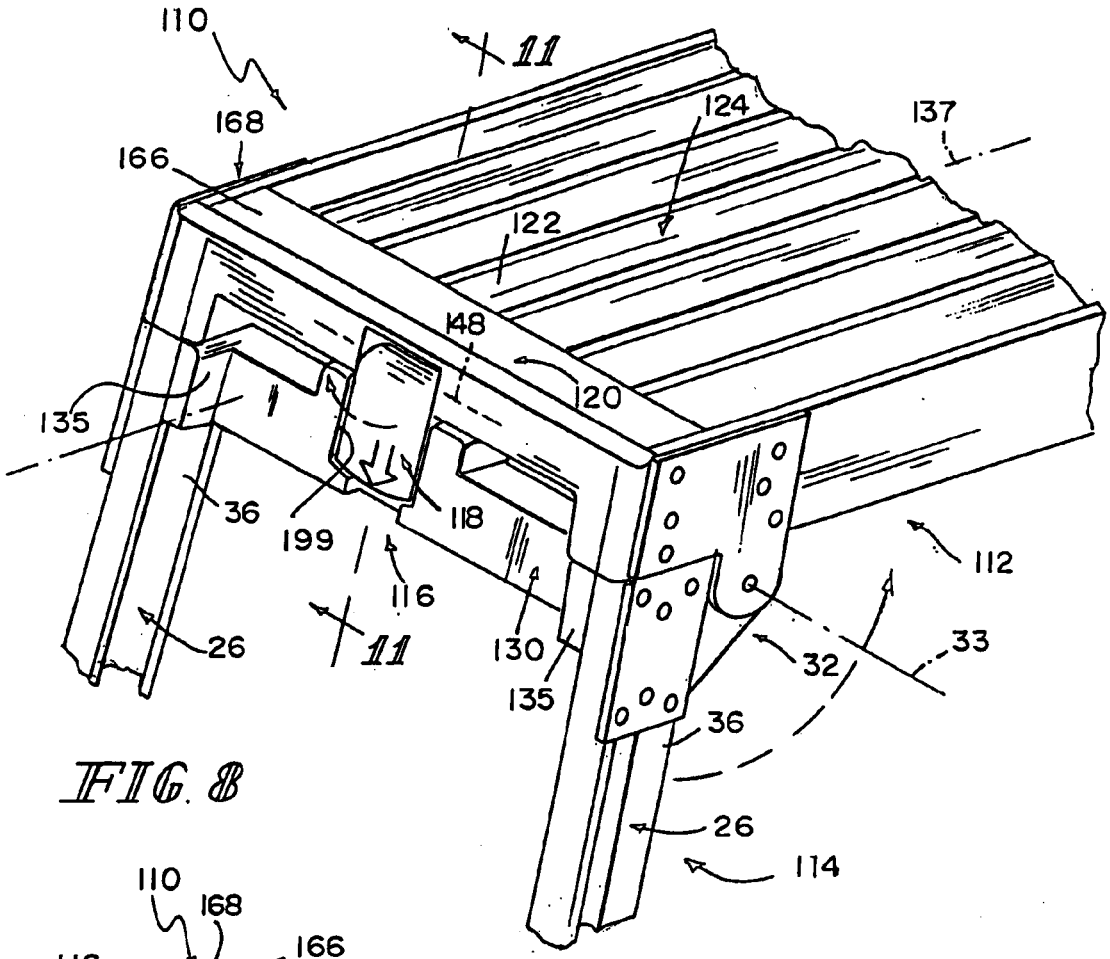
FIG. 8 is a perspective view of a second scaffold, with portions broken away, showing the scaffold including a pull-to-release latch coupled to a plank end cap and positioned in a latch position to latch to a leg unit to lock the leg unit in an extended position.

Plank end cap 120 is arranged to extend laterally along a plank end portion 122 of a plank 124, as shown in FIG. 8. A top wall 166 of plank end cap 120 provides at least a portion of a rim 168 that extends around at least a portion of plank 124. Latch 118 is positioned within a recessed portion 199 formed in a middle portion of plank end cap 120.

With respect to the materials of scaffolds 10, 110, plank end caps 20, 120 and leg connectors 30, 130 are made of, for example, a suitable plastics material. Planks 24, 124, legs 26, and steps 28 are made of, for example, aluminum or other suitable material.

What is claimed is:

1. A scaffold comprising a platform including a plank end cap and a plank to support a person thereon, the plank being elongated so as to include opposite first and second plank end portions, the plank end cap being coupled to the first plank end portion, a leg unit coupled to the platform for pivotable movement relative thereto about a leg pivot axis between an extended position and a collapsed position, and leg lock means for locking the leg unit in the extended position and for allowing pivotable movement of the leg unit between the extended position and the collapsed position, wherein the leg lock means includes a pivotable latch pivotable about a latch pivot axis and coupled to one of the leg unit to latch to the plank end cap and the plank end cap to latch to the leg unit, and wherein, upon movement of the leg unit to the extended position, the leg pivot axis is arranged to lie between the second plank end portion and the latch pivot axis.

2. The scaffold of claim 1, wherein the latch is coupled to the leg unit at the latch pivot axis and arranged to pivot relative thereto between a latch position to latch to the plank end cap to lock the leg unit in the extended position and a release position to release the plank end cap to allow pivotable movement of the leg unit from the extended position to the collapsed position and wherein the latch pivot axis cooperates with a top surface of the plank to define a space therebetween upon movement of the leg unit to the collapsed position and the leg pivot axis is arranged to lie in that space upon movement of the leg unit to the collapsed position.

3. The scaffold of claim 2, wherein the leg lock means includes a latch pivoter located between the leg unit and the latch to pivot the latch from the release position to the latch position during movement of the leg unit from the collapsed position to the extended position.

4. The scaffold of claim 3, wherein the latch pivoter is coupled to the plank end cap.

5. The scaffold of claim 1, wherein the latch is coupled to the plank end cap at the latch pivot axis and arranged to pivot relative thereto between a latch position to latch to the leg unit to lock the leg unit in the extended position and a release position to release the leg unit to allow pivotable movement of the leg unit from the extended position to the collapsed position.

6. The scaffold of claim 5, wherein the leg lock means includes a latch pivoter located between the plank end cap and the latch to pivot the latch from the release position to the latch position during movement of the leg unit from the collapsed position to the extended position.

7. The scaffold of claim 6, wherein the latch pivoter is coupled to the leg unit.

8. A scaffold comprising a platform including a plank end cap and a plank to support a person thereon, the plank being elongated so as to include opposite plank end portions, the plank end cap being coupled to one of the plank end portions, a leg unit coupled to the platform for pivotable movement relative thereto between an extended position and a collapsed position, and a latch coupled to the leg unit for pivotable movement relative thereto between a latch position to latch to the plank end cap to lock the leg unit in the extended position and a release position to release the plank end cap to allow pivotable movement of the leg unit from the extended position to the collapsed position, wherein the leg unit includes a pair of legs and a leg connector extending therebetween and the latch is coupled to the leg connector for pivotable movement and wherein the leg connector includes a leg attachment coupled to each leg and a first recessed portion positioned between the leg attachments and the latch is positioned within the recessed portion.

9. The scaffold of claim 8, wherein the first recessed portion includes an inclined wall, leg connector includes a second recessed portion recessed from the inclined wall, and further comprising a spring positioned within second recessed portion and extending therefrom into engagement with the latch.

10. A scaffold comprising a platform including a plank end cap and a plank to support a person thereon, the plank being elongated so as to include opposite plank end portions, the plank end cap being coupled to one of the plank end portions, a leg unit coupled to the platform for pivotable movement relative thereto between an extended position and a collapsed position, and a latch coupled to the leg unit for pivotable movement relative thereto between a latch position to latch to the plank end cap to lock the leg unit in the extended position and a release position to release the plank end cap to allow pivotable movement of the leg unit from the extended position to the collapsed position, wherein the leg unit includes a pair of legs and a leg connector extending therebetween and the latch is coupled to the leg connector for pivotable movement and wherein the leg connector includes an upper wall, the plank end cap includes a lower wall, and the upper and lower walls are arranged to mate with one another when the leg unit assumes the extended position.

11. A scaffold comprising a platform including a plank end cap and a plank to support a person thereon, the plank being elongated so as to include opposite plank end portions, the plank end cap being coupled to one of the plank end portions, a leg unit coupled to the platform for pivotable movement relative thereto between an extended position and a collapsed position, and a latch coupled to the leg unit for pivotable movement relative thereto between a latch position to latch to the plank end cap to lock the leg unit in the extended position and a release position to release the plank end cap to allow pivotable movement of the leg unit from the extended position to the collapsed position, wherein the plank end cap includes a latch receiver, a latch pivoter, and a pivot blocker, the latch receiver is arranged to receive the latch upon pivotable movement of the leg unit to the extended position, the latch pivoter is arranged to pivot the latch away from the latch position for reception in the latch receiver upon pivotable movement of the leg unit to the extended position, and the pivot blocker is arranged to engage the latch to block pivotable movement of the leg unit away from the extended position.

12. A scaffold comprising a platform including a plank end cap and a plank to support a person thereon, the plank being elongated so as to include opposite plank end portions, the plank end cap being coupled to one of the plank end portions, a leg unit coupled to the platform for pivotable movement relative thereto between an extended position and a collapsed position, and a latch coupled to the leg unit for pivotable movement relative thereto between a latch position to latch to the plank end cap to lock the leg unit in the extended position and a release position to release the plank end cap to allow pivotable movement of the leg unit from the extended position to the collapsed position, wherein the plank end cap is formed to include a latch-receiving opening, a latch access opening, and a passageway extending between the latch-receiving opening and the latch access opening to define a latch-receiving cavity, the latch is arranged to enter and exit the latch-receiving cavity through the latch-receiving opening upon pivotable movement of the leg unit to and from the extended position, and the latch access opening provides means for admitting a force generator into the latch-receiving cavity while the latch extends into the latch-receiving cavity through the latch-receiving opening to allow application of a release force by the force generator to the latch to pivot the latch to the release position when the latch is positioned in the latch-receiving cavity.

13. The scaffold of claim 12, wherein the plank end cap includes an edge formed to include at least part of the latch-receiving opening and the edge is arranged to engage the latch to pivot the latch away from the latch position upon pivotable movement of the leg unit from the collapsed position to the extended position.

14. The scaffold of claim 12, wherein the plank end cap includes a lower wall and an outer side wall inclined from the lower wall, the lower wall is formed to include the latch-receiving opening, and the outer side wall is formed to include the latch access opening.

15. The scaffold of claim 14, wherein the plank end cap includes a pivot blocker positioned between the lower wall and the outer wall to engage the latch to block pivotable movement of the leg unit away from the extended position.

16. A scaffold comprising a platform including a plank end can and a plank to support a person thereon, the plank being elongated so as to include opposite plank end portions, the plank end cap being coupled to one of the plank end portions, a leg unit coupled to the platform for pivotable movement relative thereto between an extended position and a collapsed position, and a latch coupled to the leg unit for pivotable movement relative thereto between a latch position to latch to the plank end can to lock the leg unit in the extended position and a release position to release the plank end cap to allow pivotable movement of the leg unit from the extended position to the collapsed position, wherein the plank end cap includes a plank receiver and a latch receiver, the plank receiver receives the one of the plank end portions, and the latch receiver is positioned below the plank receiver and arranged to receive the latch upon pivotable movement of the leg unit to the extended position.

17. The scaffold of claim 16, wherein the plank receiver has a C-shaped cross-section.

18. A scaffold comprising a platform including a plank end cap and a plank to support a person thereon, the plank being elongated so as to include opposite plank end portions, the plank end cap being coupled to one of the plank end portions, a leg unit coupled to the platform for pivotable movement relative thereto between an extended position and a collapsed position, and a latch coupled to the leg unit for pivotable movement relative thereto between a latch position to latch to the plank end can to lock the leg unit in the extended position and a release position to release the plank end cap to allow pivotable movement of the leg unit from the extended position to the collapsed position, wherein the plank end cap is formed to include a first wall extending over the one of the plank end portions, a second wall extending under the one of the plank end portions, and the one of the plank end portions is coupled to the second wall.

19. A scaffold comprising a platform including a plank end cap and a plank to support a person thereon, the plank being elongated so as to include opposite plank end portions, the plank end cap being coupled to one of the plank end portions, a leg unit coupled to the platform for pivotable movement relative thereto between an extended position and a collapsed position, and a latch coupled to the plank end cap for pivotable movement relative thereto between a latch position to latch to the leg unit to lock the leg unit in the extended position and a release position to release the leg unit to allow pivotable movement of the leg unit from the extended position to the collapsed position, wherein the latch includes a base coupled to the plank end can and a leg-engaging catch appended to the base and arranged to engage the leg unit upon movement of the leg unit to the extended position and wherein the leg-engaging catch is arranged to extend beyond an end of the plank during movement of the latch from the release position to the latch position.

20. The scaffold of claim 19, wherein the leg unit includes a latch pivoter located between the plank end cap and the latch to pivot the latch from the release position to the extended position during movement of the leg unit from the collapsed position to the extended position.

21. The scaffold of claim 19, wherein the plank end cap is formed to include a recessed portion and the latch is positioned the recessed portion.

22. The scaffold of claim 19, wherein the plank end cap includes at least a portion of a rim extending around at least a portion of the plank.

23. A scaffold comprising a platform including a plank end can and a plank to support a person thereon, the plank being elongated so as to include opposite plank end portions, the plank end can being coupled to one of the plank end portions, a leg unit coupled to the platform for pivotable movement relative thereto between an extended position and a collapsed position, and a latch coupled to the plank end cap for pivotable movement relative thereto between a latch position to latch to the leg unit to lock the leg unit in the extended position and a release position to release the leg unit to allow pivotable movement of the leg unit from the extended position to the collapsed position, wherein the leg unit includes a pair of legs and a leg connector extending therebetween, the leg connector includes a latch receiver arranged to receive the latch upon pivotable movement of the leg unit to the extended position, a latch pivoter arranged to pivot the latch away from the latch position for reception in the latch receiver, and a pivot blocker arranged to engage the latch to block pivotable movement of the leg unit away from the extended position.

24. The scaffold of claim 23, wherein the leg connector includes an upper wall, the plank end cap includes a lower wall, the upper and lower walls are arranged to mate with one another when the leg unit assumes the extended position, and the upper wall provides at least a portion of the latch pivoter.

25. A scaffold comprising a platform including a plank end cap and a plank to support a person thereon, the plank being elongated so as to include opposite plank end portions, the plank end cap being coupled to one of the plank end portions, a leg unit coupled to the platform for pivotable movement relative thereto between an extended position and a collapsed position, and a latch coupled to the plank end can for pivotable movement relative thereto between a latch position to latch to the leg unit to lock the leg unit in the extended position and a release position to release the leg unit to allow pivotable movement of the leg unit from the extended position to the collapsed position, wherein the leg unit includes a pair of legs and a leg connector extending therebetween, the leg connector includes a recessed portion, and the latch is positioned within the recessed portion.

26. A scaffold comprising a platform to support a person thereon, the platform being elongated so as to include opposite platform end portions, a leg unit pivotable about a leg pivot axis and coupled to a first of the platform end portions for pivotable movement relative to the platform between an extended position and a collapsed position, and a latch pivotable about a latch pivot axis and coupled to the leg unit for pivotable movement relative thereto between a latch position to latch to the first platform the end portion to lock the leg unit in the extended position and a release position to release the first platform end portion to allow pivotable movement of the leg unit from the extended position to the collapsed position wherein the latch pivot axis is spaced from the leg pivot axis and moves with respect to the leg pivot axis when the leg unit moves between the extended position and collapsed position.

27. The scaffold of claim 26, wherein the platform has a longitudinal axis and the latch is pivotable about a latch pivot axis that is perpendicular to the longitudinal axis of the platform.

* * * * *